US012696969B1

(12) United States Patent
Firestone et al.

(10) Patent No.: US 12,696,969 B1
(45) Date of Patent: Aug. 4, 2026

(54) NESTED DRINKING VESSELS

(71) Applicant: Buddy Cup LLC, Gadsden, AL (US)

(72) Inventors: Shaun Firestone, Gadsden, AL (US); Eric Firestone, Mt. Olive, AL (US); Felix Firestone, Hokes Bluff, AL (US)

(73) Assignee: Buddy Cup LLC, Gadsden, AL (US)

( * ) Notice: Subject to any disclaimer, the term of this patent is extended or adjusted under 35 U.S.C. 154(b) by 0 days.

(21) Appl. No.: 19/347,254

(22) Filed: Oct. 1, 2025

(51) Int. Cl.
*A45F 3/20* (2006.01)
*A45F 3/18* (2006.01)

(52) U.S. Cl.
CPC . *A45F 3/20* (2013.01); *A45F 3/18* (2013.01)

(58) Field of Classification Search
CPC ..... A45F 3/20; A45F 3/18
USPC ..... 206/217, 501–502, 505, 507, 514–515, 206/519–520
See application file for complete search history.

(56) References Cited

U.S. PATENT DOCUMENTS 795,437 A * 7/1905 Geuder ..... B65D 1/265 206/217
3,495,736 A * 2/1970 Ragettli ..... B65D 1/265 206/520
4,832,202 A * 5/1989 Newman ..... B65D 1/265 206/217
5,397,021 A * 3/1995 Usui ..... B65D 1/165 220/672
7,631,781 B2 * 12/2009 Chen ..... A47G 19/2227 206/217
2015/0208839 A1 * 7/2015 Shalmoni ..... A47G 19/23 206/514
2022/0134405 A1 * 5/2022 Whitmore ..... B21D 51/2646 206/519

* cited by examiner

*Primary Examiner* — Luan K Bui

(74) *Attorney, Agent, or Firm* — Womble Bond Dickinson (US) LLP

(57) ABSTRACT

A nested vessel assembly includes a first vessel and a second vessel. The first vessel has a first body that extends from a first lip to a first bottom to define a first containment volume within the first body. The second vessel has a second body that extends from a second lip to a second bottom to define a second containment volume within the second body. The second containment volume is substantially equal to the first containment volume. The nested vessel assembly has a nested configuration in which the second vessel is releasably secured to the first vessel with the first vessel disposed within the second containment volume such that the first bottom is adjacent the second bottom.

16 Claims, 4 Drawing Sheets

NESTED DRINKING VESSELS

BACKGROUND

1. Technical Field

The present disclosure relates to portable drinking vessels, and more particularly to a nested vessel assembly comprising two separable vessels that can be joined together via threaded connections to form a single compact unit for transport or separated to provide two individual drinking cups.

2. Discussion of Related Art

In various social and recreational settings, individuals often find themselves in situations where multiple drinking vessels would be beneficial but are not readily available. Whether at outdoor gatherings, camping trips, picnics, or other group activities people frequently encounter scenarios where they have brought only a single cup or tumbler but discover a desire or need to share beverages with others.

Traditional approaches to addressing this situation typically involve carrying multiple separate cups, which increases bulk and weight in portable scenarios, or relying on disposable cups, which creates environmental waste. Alternatively, individuals may resort to sharing a single vessel by passing it between users, which raises hygiene concerns and may be socially awkward or undesirable in many contexts.

The portability and convenience factors become particularly relevant in outdoor activities, travel situations, and events where space and weight considerations limit what individuals can practically carry. In such contexts, the ability to have access to multiple functional drinking vessels while maintaining the compact profile of a single container during transport would provide practical advantages.

Current drinking vessel designs generally focus on optimizing individual use rather than addressing the occasional need for multiple vessels from a single portable unit. While various multi-component drinking systems exist, they often involve separate pieces that must be tracked and managed independently, potentially leading to loss of components or increased complexity in packing and transport.

The field would benefit from drinking vessel solutions that can adapt to varying social situations while maintaining practical portability characteristics and addressing both convenience and hygiene considerations in shared drinking scenarios.

SUMMARY

In an aspect of the present disclosure, a nested vessel assembly includes a first vessel and a second vessel. The first vessel has a first body that extends from a first lip to a first bottom to define a first containment volume within the first body. The second vessel has a second body that extends from a second lip to a second bottom to define a second containment volume within the second body. The second containment volume is substantially equal to the first containment volume. The nested vessel assembly has a nested configuration in which the second vessel is releasably secured to the first vessel with the first vessel disposed within the second containment volume such that the first bottom is adjacent the second bottom.

In aspects, the height of the nested vessel assembly in the nested configuration is substantially equal to the height of the first vessel. The first containment volume may have a total volume in a range of 8 ounces to 64 ounces. The first containment volume may have a total volume of 24 ounces.

In some aspects, the first body includes a first securement means and the second body includes a second securement means for selectively engaging a first securement means. The first securement means and the second securement means may releasably secure the first vessel to the second vessel. The first body may include a first helical groove and the second body may include a second helical groove that selectively engages the first helical groove to releasably secure the first vessel to the second vessel. The second helical groove may be spaced from the second lip.

In certain aspects, the nested vessel assembly includes a lid that is configured to releasably secure to the first body to enclose the first containment volume and to releasably secure to the second body to enclose the second containment volume.

In another aspect of the present disclosure, the nested vessel assembly includes a first vessel and a second vessel. The first vessel has a first body that extends from a first lip to a first bottom to define a first height from the first lip to the first bottom. The second vessel has a second body that extends from the second lip to a second bottom to define a second height from the second lip to the second bottom. The nested vessel assembly has an assembly height in a nested configuration in which the first vessel is releasably secured within the second vessel with the first bottom adjacent the second bottom. The assembly height being substantially equal to the first height.

In aspects, the first vessel defines a first containment volume and the second vessel defines a second containment volume that is substantially equal to the first containment volume. The first containment volume may have a total volume in a range of 8 ounces 64 ounces. The first containment volume may have a total volume of 24 ounces.

In some aspects, the first body includes a first securement means and the second body includes a second securement means for selectively engaging the first securement means. The first securement means and the second securement means releasably secured the first vessel to the second vessel. The first body may include a first helical groove and the second body may include a second helical groove that selectively engages the first helical groove to releasably secure the first vessel to the second vessel. The second helical groove may be spaced from the second lip.

In another aspect of the present disclosure, the nested vessel assembly includes a first vessel, a second vessel, and a securement means for releasably securing the second vessel to the first vessel with the first vessel disposed within a second body of the second vessel. The first vessel has a first body that defines a first containment volume. The second vessel has the second body that defines a second containment volume that is substantially equal to the first containment volume.

In aspects, an assembly height of the nested vessel assembly in the nested configuration is substantially equal to the height of the first vessel. The first containment volume may have a total volume in a range of 8 ounces to 64 ounces. The first containment volume may have a total volume of 24 ounces.

In some aspects, the securement means includes a first helical groove defined in the first body and a second helical groove defined in the second body that threadably engages the first helical groove to releasably secure the first vessel to the second vessel.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
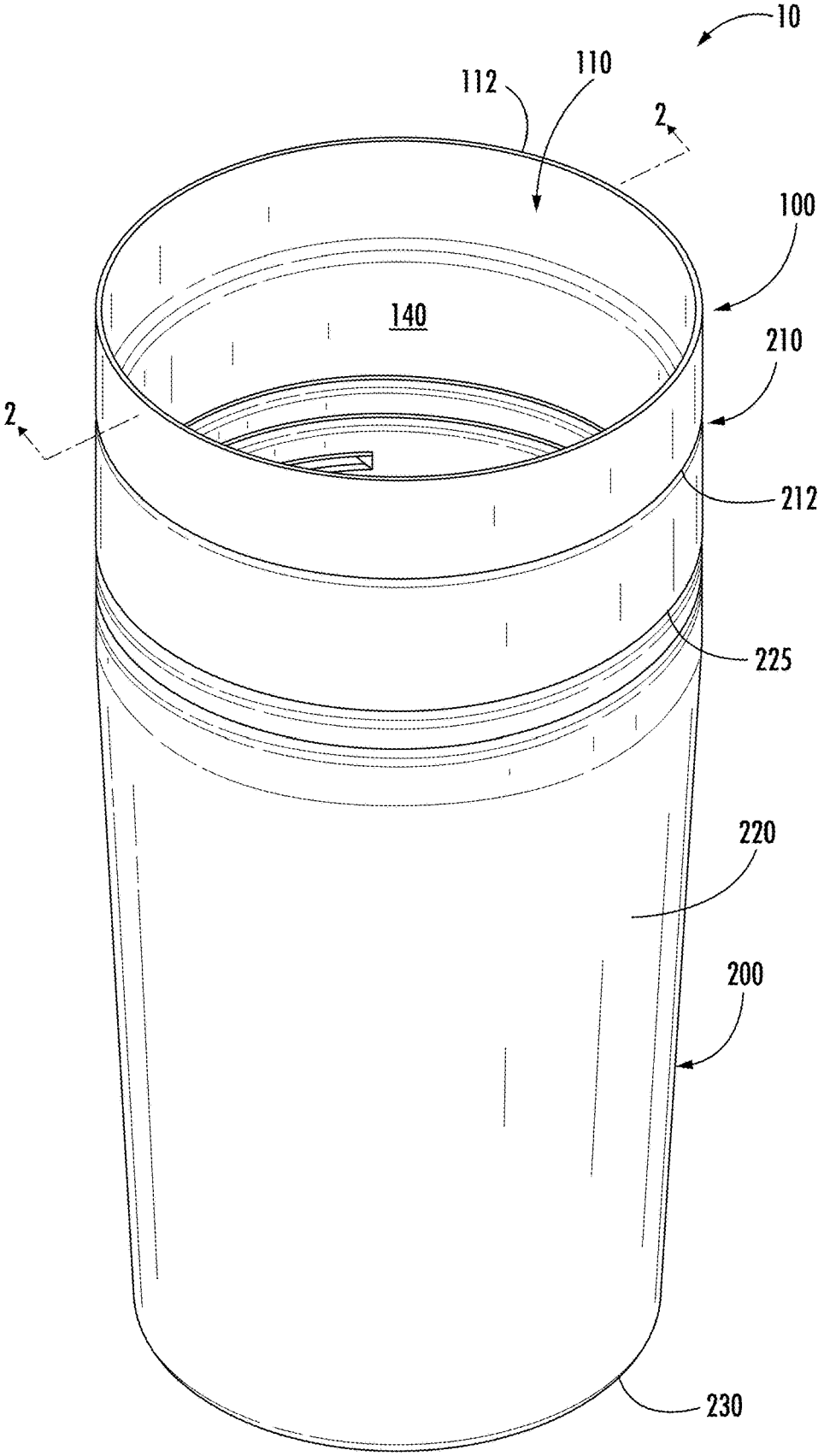
FIG. 1 is a perspective view of a nested vessel assembly provided in accordance with the present disclosure.
Figure 2:
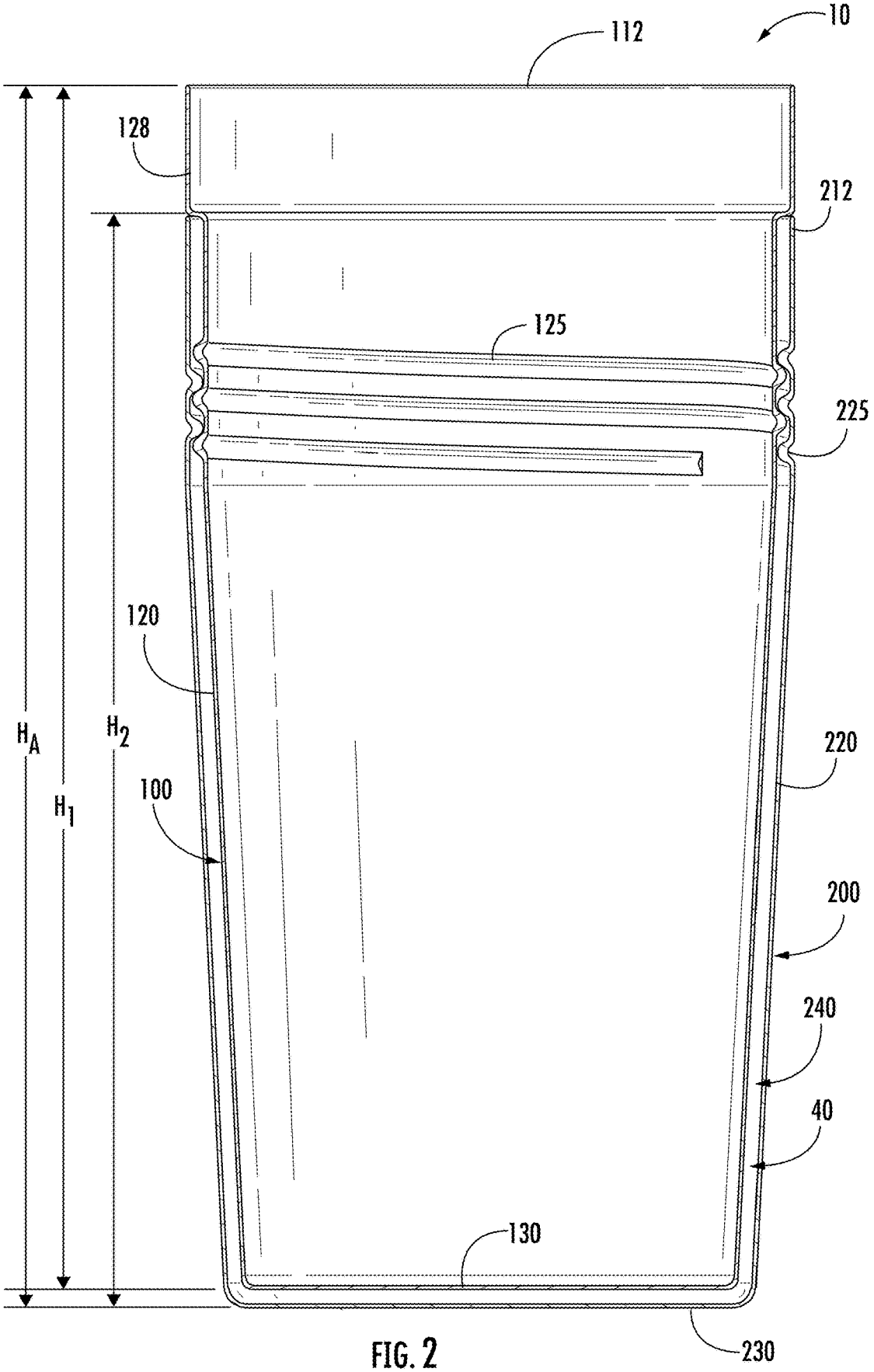
FIG. 2 is a vertical cross-sectional view of the nested vessel assembly of FIG. 1.
Figure 3:
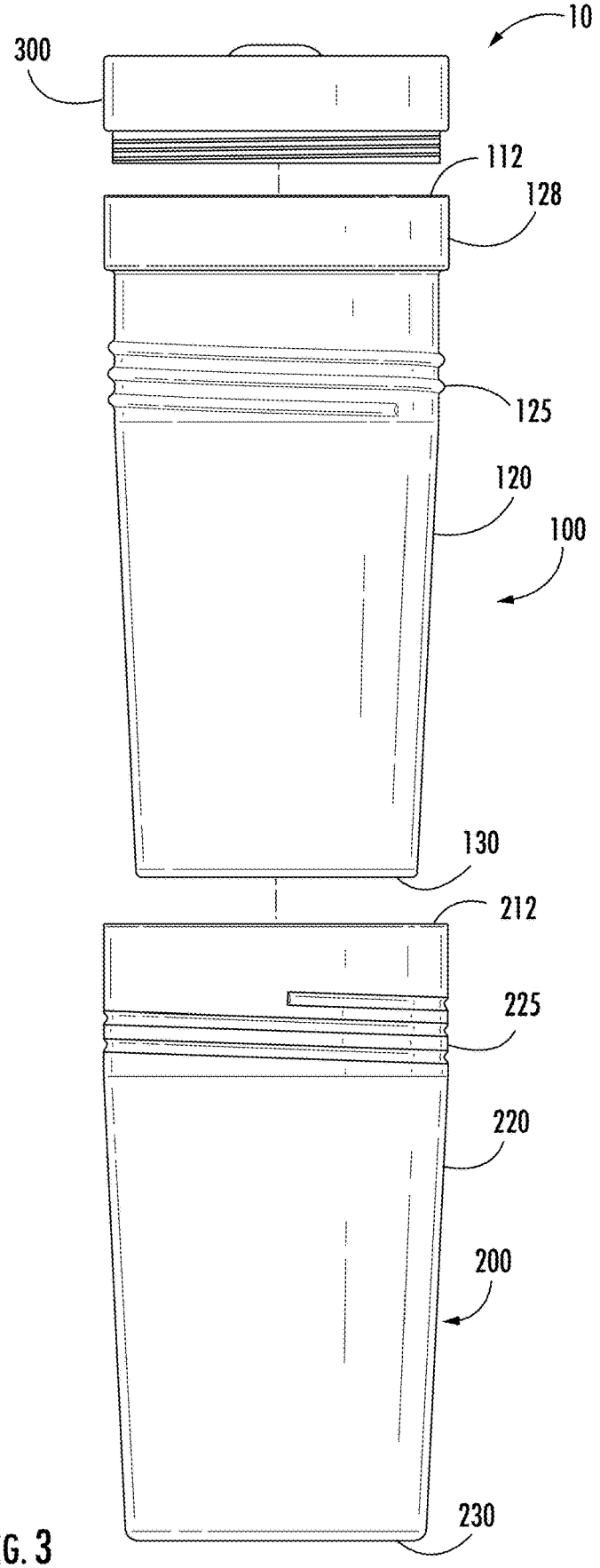
FIG. 3 is an exploded view of the nested vessel assembly of FIG. 1 with an inner vessel separated from a lower vessel.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used herein, the phrase "configured to" describes a related element that must be made, suited by nature, character, or designed for a particular use, purpose, or situation. In contrast, the phrase "capable of" describes a related element that only needs to be suitable for a particular use, purpose, or situation.

The present disclosure relates to a nested vessel assembly that addresses the common challenge of needing multiple drinking containers in various social and outdoor settings. The assembly provides a portable drinking solution that may function as either a single compact unit for individual use or as two separate vessels for sharing purposes. In many situations, such as picnics, hiking trips, campus events, tailgating, or road trips, an individual may find themselves with a single drinking container but with a desire to share beverages with others. Traditional solutions often involve using disposable cups, which may create environmental waste, or sharing a single container, which may raise hygiene concerns.

The nested vessel assembly described herein may offer an alternative approach by incorporating two vessels that can be joined together to form a single compact unit during transport and storage. When the need arises for multiple drinking containers, the assembly can be separated into two individual vessels of substantially equal capacity. This configuration may eliminate the need for additional disposable containers while providing each user with their own hygienic drinking vessel. The assembly may be particularly suitable for situations where portability and convenience are considerations as the nested configuration may reduce the overall space requirements compared to carrying multiple separate containers.

The vessels in the assembly may be designed to connect through a threaded engagement system that allows for secure attachment when joined and easy separation when individual containers are needed. This connection mechanism may provide a reliable joining method while allowing users to quickly and intuitively separate the vessels with a simple twisting motion. The assembly may maintain the appearance and functionality of a conventional drinking container when the vessels are joined together, while providing the flexibility to create two separate containers when circumstances require sharing or multiple users. In addition, the second or outer vessel may be kept clean during use and only be accessible or exposed when separated from the first or inner vessel.

The nested vessel assembly may be constructed from durable materials that provide longevity and resistance to wear from repeated assembly and disassembly cycles. The design may incorporate features that enhance the user experience, such as insulation properties for temperature retention and ergonomic considerations for comfortable handling. The assembly may also accommodate additional components, such as lids or covers, that can be used with either the joined configuration or the individual separated vessels, further enhancing the versatility and functionality of the system.

Referring to FIGS. 1-4, a nested vessel assembly 10 is provided in accordance with embodiments of the present disclosure. The nested vessel assembly 10 includes an inner vessel 100 and an outer vessel 200. The terms inner and outer may be replaced with top and bottom or first and second. As shown, the inner vessel 100 may be positioned within outer vessel 200 in a nested configuration. In the nested configuration, the inner vessel 100 is releasably secured within the outer vessel 200 such that the inner vessel 100 functions as a drinking cup for the nested assembly 10 when in the nested configuration. As used herein, "releaseably secured" requires that two components are held together by a securement means that require a positive force to disengage one component from the other and is more than simply stacking two identical components together.

The inner vessel 100 includes an inner body 120 that is substantially cylindrical with a bottom 130 closing a lower end of the body 120. The inner body 120 includes a lip 112 that is opposite the bottom 130 and defines an inner vessel opening 110. The inner body 120 defines an inner containment volume 140 that is accessible through the inner vessel opening 110. The inner vessel opening 110 provides access to the inner containment volume 140 of the inner vessel 100 for filling, drinking, and cleaning purposes. The inner vessel opening 110 may be dimensioned to accommodate standard drinking activities while maintaining structural integrity of the inner vessel 100. In some cases, the inner vessel opening 110 may be configured to receive a lid or cover component 300 (FIG. 3) that can seal the opening when the nested vessel assembly 10 is in use or during transport.

The inner body 120 forms the main structural portion of the inner vessel 100. The inner body 120 may extend from the inner vessel opening 110 downward to form the inner containment volume 140 for beverages or other liquids. As shown in FIG. 1, the inner body 120 may exhibit a tapered configuration where the diameter varies along the height of the inner vessel 100.

With continued reference to FIGS. 1-4, the inner vessel 100 includes a securement means to secure the outer vessel 200 to the inner vessel 100 in the nested configuration. The securement means may incorporate an inner helical groove 125 that serves as a connection mechanism for securing the outer vessel 200 to the inner vessel 100. The inner helical groove 125 may be formed on an exterior surface of the inner body 120, creating a threaded pattern that can engage with a corresponding threaded feature on a mating component. The inner surface of the inner vessel 100 may be smooth or may include portions of the inner helical groove 125. The helical configuration of the inner helical groove 125 may allow for rotational engagement and disengagement, enabling users to join or separate the inner vessel 100 through a twisting motion. In some embodiments, the inner helical groove 125 may be machined or formed during the manufacturing process of the inner body 120 to ensure precise threading dimensions and engagement characteristics.

Figure 4:
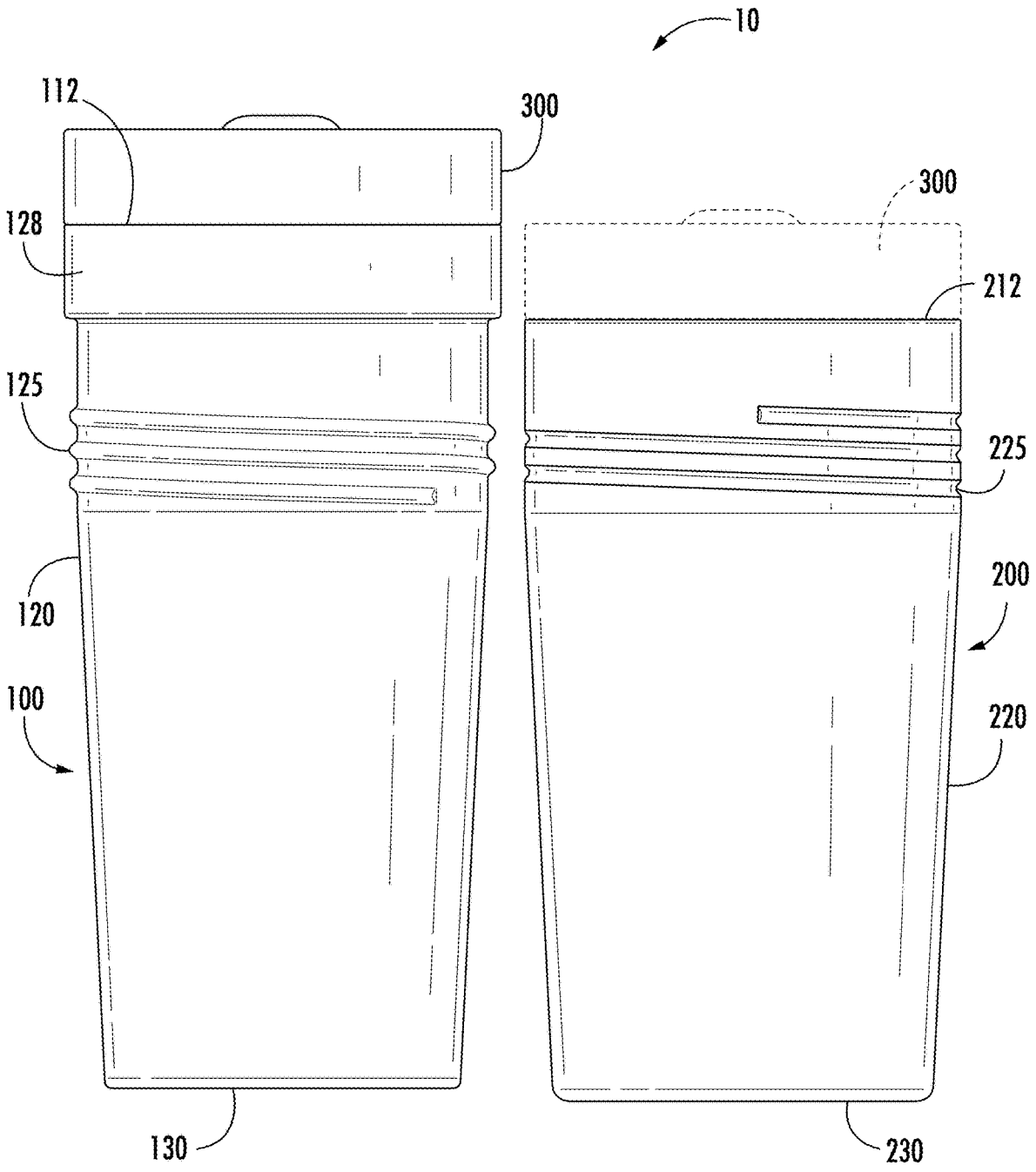
FIG. 4 is a perspective view of the inner vessel separated from the lower vessel of FIG. 1 with a lid provided in accordance with the present disclosure.

The dimensional characteristics of the inner vessel 100 may contribute to the overall functionality and portability of the nested vessel assembly 10. The inner vessel 100 may be dimensioned such that the inner containment volume 140 is in a range of 8 ounces to 64 ounces, e.g., 8, 12, 16, 20, 24, 28, 30, 40, 48, or 64 ounces. The inner containment volume 140 may provide adequate capacity for individual beverage consumption while maintaining a manageable size for handling and storage. The inner body 120 may exhibit a double-walled construction that creates an insulating air gap between inner and outer walls thereof. The double-walled construction, which may enhance temperature retention properties for both hot and cold beverages. When the inner vessel 100 is joined with a corresponding outer vessel 200 through engagement of the inner helical groove 125, the nested configuration has an assembly height HA that is substantially equal to the height H1 of the inner vessel 100. For example, the inner vessel 100 may have a height H1 that is in a range of 80 percent to 100 percent, e.g., 80, 85, 90, 95, or 100 percent, of the assembly height HA of the nested vessel assembly 10 in the nested configuration. In certain embodiments, only an upper section 128 of the inner body 120 extends above a top of the outer vessel 200 when side by side with one another as shown in FIG. 4. This configuration may create a compact yet functional drinking container that can be separated into two individual vessels when sharing is desired.

Continuing to refer to FIGS. 1-4, the outer vessel 200 may serve as the lower component of the nested vessel assembly 10 and may be configured to receive and engage with the inner vessel 100 through a complementary connection mechanism. The outer vessel 200 may be designed to function as an individual drinking container when separated from the inner vessel 100, providing users with a second vessel for sharing beverages or accommodating multiple users. In some cases, the outer vessel 200 may be constructed from the same materials as the inner vessel 100 to ensure consistency in durability, appearance, and performance characteristics.

The outer vessel 200 includes an outer body 220 that is substantially cylindrical with a bottom 230 closing a lower end of the outer body 220. The outer body 220 includes a lip 212 that is opposite the bottom 230 and defines an outer vessel opening 210. The outer body 220 defines an outer containment volume 240 that is accessible through the outer vessel opening 210. The outer vessel opening 210 provides access to the outer containment volume 240 of the outer vessel 200 for filling, drinking, and cleaning purposes. The outer vessel opening 210 may be dimensioned to accommodate standard drinking activities while maintaining structural integrity of the outer vessel 200. In some cases, the outer vessel opening 210 may be configured to receive a lid or cover component 300 (FIG. 4) that can seal the opening when the nested vessel assembly 10 is in use or during transport. The same lid may fit both the inner vessel opening 110 and the outer vessel opening 210.

The outer vessel 200 incorporates securement means that allows the outer vessel 200 to nest within the inner vessel 100 in a secure and stable configuration while maintaining the ability to be easily separated when individual vessels are desired. The securement means may include an outer helical groove 225 that serves as a connection mechanism for securing the outer vessel 200 to the inner vessel 100. The outer helical groove 225 may be formed on an interior surface of the outer body 220, creating a threaded pattern that can engage with a corresponding threaded feature of the inner vessel 100. The outer surface of the outer wall 220 may be smooth or may include portions of the outer helical groove 225. The helical configuration of the outer helical groove 225 may allow for rotational engagement and disengagement, enabling users to join or separate the outer vessel 200 through a twisting motion. In some cases, the outer helical groove 225 may be machined or formed during the manufacturing process of the outer body 220 to ensure precise threading dimensions and engagement characteristics.

The dimensional characteristics of the outer vessel 200 may be substantially similar to the inner vessel 100. The outer vessel 200 may be dimensioned such that the outer containment volume 240 is in a range of 8 ounces to 64 ounces, e.g., 8, 12, 16, 20, 24, 28, 30, 40, 48, or 64 ounces, and may be substantially equal to the inner containment volume 140. For example, the inner containment volume 140 may be in a range of 90 percent to 125 percent, e.g., 90, 95, 100, 105, 110, 115, 120, or 125 percent, of the volume of the outer containment volume 240. The inner vessel 100 and the outer vessel 200 may have a height that are substantially equal to one another. For example, the inner vessel 100 may have a height H1 that is in a range of 90 percent to 125 percent, e.g., 90, 95, 100, 105, 110, 115, 120, or 125 percent, of the height H2 of the outer vessel 200. The outer body 220 may exhibit a double-walled construction that creates an insulating air gap between inner and outer walls thereof. The double-walled construction, which may enhance temperature retention properties for both hot and cold beverages.

Alternative connection mechanisms may be employed in place of the helical groove system to join the inner vessel 100 and the outer vessel 200 together. In some cases, snap-together connection mechanisms may be incorporated into the design to provide an alternative joining method that may offer different user interaction characteristics compared to threaded engagement. Such snap-together mechanisms may include resilient tabs, detent features, or bayonet-style connections that allow the vessels to be joined through linear or rotational motions followed by a locking engagement. The snap-together connection mechanisms may provide audible or tactile feedback to users when the vessels are properly engaged, and may allow for quick separation through activation of release features or application of separation forces. These alternative connection mechanisms may be integrated into the outer body 220 and corresponding areas of the inner vessel 100 to maintain the overall functionality and appearance of the nested vessel assembly 10 while providing different assembly and disassembly characteristics that may appeal to different user preferences or application requirements.

The interaction between the inner vessel 100 and the outer vessel 200 through the respective connection mechanisms may create a secure and functional assembled configuration that enhances the overall utility of the nested vessel assembly. When the inner helical groove 125 and outer helical groove 225 are brought into engagement through rotational motion, the threaded surfaces may interlock to form a mechanical connection that maintains the vessels in a fixed relationship during use and transport. For example, the threaded surfaces may include a tab and detent feature or a tab and tab feature at one end of the respective grooves that interact to resist disengagement to prevent unintentional disengagement. In some embodiments, the inner helical groove 125 and/or the outer helical groove 225 may include features or coatings to increase frictional engagement between the inner vessel 100 and the outer vessel 200. The helical groove engagement may distribute connection forces across multiple contact points along the threaded surfaces, which may provide stability and resistance to separation under normal handling conditions. In some cases, the thread pitch and depth of the helical grooves may be optimized to balance ease of assembly and disassembly with connection security, allowing users to join or separate the vessels through moderate rotational force while maintaining reliable engagement during typical use scenarios.

The inner body 120 or the outer body 220 may be constructed from stainless steel, which may provide durability and resistance to corrosion while offering an aesthetically pleasing appearance. The stainless-steel construction of the inner body 120 or the outer body 220 may also facilitate cleaning and maintenance of the inner vessel 100 or the outer vessel 200 over repeated use cycles. In some embodiments, the outer surface of the inner body 120 or the outer body 220 may be coated with a material to change aesthetics, durability, comfort, or insulative properties of the inner vessel 100 or the outer vessel 200. In certain embodiments, the exterior surface of the inner body 120 or the outer body 220 may be partially coated with one or more different materials. In particular embodiments, the exterior surface of the inner body 120 or the outer body 220 may include partial or total coatings of multiple different materials. While stainless steel may provide durability and resistance to corrosion, other materials such as aluminum or polymers (e.g., thermoplastic, thermosets, or elastomers) are contemplated for the main structural component or a coating of the inner body 120 or the outer body 220.

The assembled configuration may exhibit enhanced insulation properties through the double-walled construction of both vessel components. When the inner vessel and outer vessel are joined together through the helical groove engagement, the double-walled structure of each vessel may create multiple insulating air gaps that contribute to temperature retention performance. The air spaces between the inner and outer walls of each vessel may serve as thermal barriers that reduce heat transfer between the contained beverage and the external environment. In some cases, the assembled configuration may provide improved insulation characteristics compared to single-walled containers of similar size, as the multiple wall layers and air gaps may work in combination to maintain beverage temperatures for extended periods. The stainless-steel construction of the vessel walls may further contribute to thermal performance by providing low thermal conductivity characteristics that complement the insulating air gap design.

The double-walled construction may function effectively in both the assembled and separated configurations of the nested vessel assembly. When the vessels are joined together, the combined thermal mass and insulation properties of both double-walled components may enhance overall temperature retention for the contained beverage. When the vessels are separated into individual drinking containers, each vessel may maintain its individual double-walled insulation characteristics, allowing both users to benefit from temperature retention properties in their respective containers. The air gaps within each double-walled vessel may remain intact and functional regardless of whether the vessels are in the assembled or separated state, providing consistent thermal performance across different usage configurations.

A lid component 300 may be incorporated into the nested vessel assembly 10 to provide additional functionality and convenience for users in various operational scenarios. The lid component 300 may be configured to cover the inner vessel opening 110 when the vessels 100, 200 are in the assembled configuration, creating a sealed container that may prevent spillage during transport and reduce heat loss or gain through the inner vessel opening 110. In some cases, the lid component 300 may incorporate sealing features such as gaskets or compression seals that create a tight fit with the rim of the inner vessel opening 110, enhancing the containment properties of the assembled system. The lid component 300 may be constructed from materials that complement the stainless-steel vessel construction, such as food-grade plastics or matching stainless-steel, and may incorporate features such as drinking spouts, vent holes, or grip surfaces that enhance user interaction with the assembled vessel.

The lid component 300 may also provide functionality when the vessels 100, 200 are separated into individual containers, offering versatility in how users interact with the system across different usage scenarios. When the inner vessel 100 and outer vessel 200 are disengaged from each other, the lid component 300 may be used to cover either the inner vessel opening 110 or the outer vessel opening 210, depending on user preferences or specific usage requirements. In some cases, multiple lid components 300 may be provided with the nested vessel assembly, allowing both separated vessels to be covered simultaneously when individual sealed containers are desired. The lid component 300 may incorporate attachment features such as tethers or clips that prevent loss of the lid during use and transport, and may be designed to nest or stack with the vessels when not in use to maintain the compact storage characteristics of the overall system.

In a separated configuration, the first vessel 100 and the second vessel 200 have a total volume that is substantially equal to one another. In the separated configuration the first vessel 100 and the second vessel 200 may each be used as a drinking vessel. The nested vessel assembly 10 allows for a user to carry and use the first vessel 100 as a regular cup and when there is a need for a second cup, the second vessel 200 may be separated and provided to a second user to use as a cup. The nested vessel assembly 10 allows for a user to use and carry the nested vessel assembly 10 without having to worry about the separation of the two vessels 100, 200. For example, a user may twist the first vessel 100 relative to the second vessel 200 to release the second vessel 200 from the first vessel 100.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A nested vessel assembly comprising:

a first vessel having a first body, the first body extending from a first lip to a first bottom to define a first containment volume within the first body, the first body having an internal surface and an external surface opposite the internal surface between the first lip and the first bottom, a first helical groove defined on the external surface of the first body, the first helical groove continuously extending around the entire circumference of the external surface of the first body; and a second vessel having a second body, the second body extending from a second lip to a second bottom to define a second containment volume within the second body, the second containment volume substantially equal to the first containment volume, the first vessel and the second vessel sized and dimensioned different from one another; the second body having an internal surface and an external surface opposite the internal surface between the second lip and the second bottom, a second helical groove defined on the internal surface of the second body, the nested vessel assembly having a nested configuration in which the first helical groove is threadably engaged with the second helical groove to releaseably secure the second vessel to the first vessel with the first vessel disposed within the second containment volume such that the first bottom is adjacent the second bottom.

2. The nested vessel assembly according to claim 1, wherein the height of the nested vessel assembly in the nested configuration is substantially equal to the height of the first vessel.

3. The nested vessel assembly according to claim 1, wherein the first containment volume has a total volume of in a range 8 ounces to 64 ounces.

4. The nested vessel assembly according to claim 1, wherein the first containment volume has a total volume of 24 ounces.

5. The nested vessel assembly according to claim 1, wherein the second helical groove is spaced from the second lip.

6. The nested vessel assembly according to claim 1, further comprising a lid, the lid configured to releasably secure to the first body to enclose the first containment volume and to releasably secure to the second body to enclose the second containment volume.

7. A nested vessel assembly comprising:

a first vessel having a first body, the first body extending from a first lip to a first bottom to define a first height from the first lip to the first bottom, the first body having an internal surface and an external surface opposite the internal surface between the first lip and the first bottom, a first helical groove defined on the external surface of the first body and continuously extending around the entire circumference of the external surface of the first body; and a second vessel having a second body, the second body extending from a second lip to a second bottom to define a second height from the second lip to the second bottom, the second height being different from the first height, the second body having an internal surface and an external surface opposite the internal surface between the second lip and the second bottom, a second helical groove defined on the internal surface of the second body, the nested vessel assembly having an assembly height in a nested configuration in which the first helical groove is threadably engaged with the second helical groove to releaseably secure the first vessel within the second vessel with the first bottom adjacent to the second bottom, the assembly height being substantially equal to the first height.

8. The nested vessel assembly according to claim 7, wherein the first vessel defines a first containment volume and the second vessel defines a second containment volume that is substantially equal to the first containment volume.

9. The nested vessel assembly according to claim 8, wherein the first containment volume has a total volume of in a range 8 ounces to 64 ounces.

10. The nested vessel assembly according to claim 8, wherein the first containment volume has a total volume of 24 ounces.

11. The nested vessel assembly according to claim 8, wherein the second helical groove is spaced from the second lip.

12. A nested vessel assembly comprising:

a first vessel having a first body including a first sidewall, the first body defining a first containment volume;

a second vessel having a second body including a second sidewall, the second body defining a second containment volume substantially equal to the first containment volume, the second vessel sized and dimensioned different from the first vessel; and a securement means for releasably securing the first vessel to the second vessel with the first vessel disposed within the second body, the securement means including a first portion defined in an exterior surface of the first sidewall and a second portion defined in an interior surface of the second sidewall, the first portion and the second portion configured to cooperatively engage one another to releasably secure the first vessel to the second vessel, the first portion continuously extending around the entire circumference of the external surface of the first body.

13. The nested vessel assembly according to claim 12, wherein an assembly height of the nested vessel assembly in the nested configuration is substantially equal to the height of the first vessel.

14. The nested vessel assembly according to claim 12, wherein the first containment volume has a total volume of in a range 8 ounces to 64 ounces.

15. The nested vessel assembly according to claim 12, wherein the first containment volume has a total volume of 24 ounces.

16. The nested vessel assembly according to claim 12, wherein the securement means includes a first helical groove defined in the first body and a second helical groove defined in the second body that threadably engages the first helical groove to releaseably secure the first vessel to the second vessel.

* * * * *